US010916868B2

(12) United States Patent
Bogursky

(10) Patent No.: US 10,916,868 B2
(45) Date of Patent: Feb. 9, 2021

(54) PRESS-FIT CONTACT PIN

(71) Applicant: Interplex Industries, Inc., East Providence, RI (US)

(72) Inventor: Robert Martin Bogursky, Encinitas, CA (US)

(73) Assignee: Interplex Industries, Inc., East Providence, RI (US)

( * ) Notice: Subject to any disclaimer, the term of this patent is extended or adjusted under 35 U.S.C. 154(b) by 0 days.

(21) Appl. No.: 16/496,044

(22) PCT Filed: Mar. 28, 2018

(86) PCT No.: PCT/US2018/024834
§ 371 (c)(1),
(2) Date: Sep. 20, 2019

(87) PCT Pub. No.: WO2018/187120
PCT Pub. Date: Oct. 11, 2018

(65) Prior Publication Data

US 2020/0028287 A1 Jan. 23, 2020

Related U.S. Application Data

(60) Provisional application No. 62/480,675, filed on Apr. 3, 2017.

(51) Int. Cl.
*H01R 12/58* (2011.01)
*H01R 43/16* (2006.01)

(52) U.S. Cl.
CPC ..... *H01R 12/58* (2013.01); *H01R 43/16* (2013.01)

(58) Field of Classification Search
CPC ..... H01R 12/58; H01R 43/16; H01R 12/585; H01R 43/205; H01R 13/08; H05K 1/181; H05K 3/3405
USPC ..... 174/126.3; 439/567, 82, 751
See application file for complete search history.

(56) References Cited

U.S. PATENT DOCUMENTS

| | | | | |
|---|---|---|---|---|
| 3,634,819 A | | 1/1972 | Evans | |
| 4,768,980 A | * | 9/1988 | Collier | H01R 12/585 439/751 |
| 4,793,817 A | | 12/1988 | Hiesbock | |
| 5,230,642 A | | 7/1993 | Schempp | |
| 5,823,830 A | | 10/1998 | Wurster | |
| 5,893,779 A | | 4/1999 | Bianca et al. | |

(Continued)

FOREIGN PATENT DOCUMENTS

EP 0208500 A1 1/1987

OTHER PUBLICATIONS

International Search Report and Written Opinion, dated Jun. 14. 2018, for PCT/US2018/024834, filed on Mar. 28, 2018.

*Primary Examiner* — Timothy J Thompson
*Assistant Examiner* — Guillermo J Egoavil
(74) *Attorney, Agent, or Firm* — Katterle Nupp LLC; Paul Katterle; Robert Nupp

(57) ABSTRACT

An electrically conductive contact and a method of forming the same from a length of wire are disclosed. The contact has a pin section connected to a fastening section. The fastening section is adapted for press-fitting into the hole of a substrate and includes a solid tip, a neck connected to the pin section, first and second arcuate side surfaces, and first and second major surfaces through which an enlarged slot extends. Each of the first and second major surfaces is at least partially flattened.

17 Claims, 7 Drawing Sheets

(56) References Cited

U.S. PATENT DOCUMENTS

| | | | | |
|---|---|---|---|---|
| 5,915,759 | A | 6/1999 | Logerot et al. | |
| 6,052,895 | A | 4/2000 | Bianca et al. | |
| 6,190,214 | B1 | 2/2001 | Bianca et al. | |
| 6,231,402 | B1 | 5/2001 | Kikuchi | |
| 7,228,628 | B2 | 6/2007 | Wolfel et al. | |
| 7,445,499 | B2 | 11/2008 | Nunokawa et al. | |
| 7,670,196 | B2 | 3/2010 | Fedder et al. | |
| 8,092,262 | B1 | 1/2012 | Frederick et al. | |
| 8,313,344 | B2 | 11/2012 | Johnescu et al. | |
| 9,093,780 | B2 | 7/2015 | Miyake | |
| 2007/0010139 | A1* | 1/2007 | Chen | H01R 12/585 439/751 |
| 2016/0197419 | A1* | 7/2016 | Uchida | H01R 43/16 439/751 |
| 2020/0280144 | A1* | 9/2020 | Parrish | H01R 12/523 |

* cited by examiner

PRESS-FIT CONTACT PIN

CROSS-REFERENCE TO RELATED APPLICATION(S)

This application claims priority under 35 U.S.C. § 119(e) to Provisional Patent Application No. 62/480,675, filed on Apr. 3, 2017, which is herein incorporated by reference.

TECHNICAL FIELD

The present disclosure relates to an electrical contact and more particularly to a contact pin adapted to be press-fit into a hole of a substrate, such as a printed circuit board (PCB).

BACKGROUND

In electronic systems utilizing one or more PCBs, a PCB is often electrically connected to other electrical devices (such as other PCBs) by electrical connectors. In many instances, an electrical connector will utilize one or more contact pins that are fixed in electrically conductive hole(s) of the PCB. Such a contact pin may be secured within a hole of a PCB by soldering or by a retention feature of the contact pin. In the latter instance, the contact pin is typically referred to as a press-fit contact pin.

Conventionally, a press-fit contact pin includes a compliant fastening section that plastically and elastically deforms as it is inserted into the PCB hole. This deformation creates a retention force that holds the fastening section in the PCB hole. A number of different types of construction have been used for the fastening section, one of which is known as an "eye of the needle" type of construction. In this type of construction, a slot or hole is formed in the fastening section so as to define a pair of beams that are resiliently movable toward and away from each other to provide a normal force against the PCB hole, thereby providing a reliable electrical connection.

As time progresses, electronic systems become smaller and smaller. As a result, the size of PCB holes and contact pins become smaller. This reduction in size makes it more difficult to produce press-fit contact pins, particularly "eye of the needle" press-fit contact pins. As such, it would be desirable to provide an improved "eye of the needle" press-fit contact pin and a method of making the same that are well-suited for applications requiring small dimensions.

SUMMARY

An electrically conductive contact is disclosed. The contact has a longitudinal axis and is for mounting to a substrate having a hole formed therein. The contact includes an elongated electrically conductive pin section extending along the longitudinal axis and a fastening section connected to the pin section. The fastening section has an enlarged slot extending therethrough in a direction normal to the longitudinal axis. The slot has an inner end disposed proximate the pin section and an outer end disposed distal to the pin section. The fastening section is adapted for press-fitting into the hole of the substrate and includes a solid tip, a neck connected to the pin section, first and second side surfaces, and first and second major surfaces through which the enlarged slot extends. The first and second major surfaces extend between the tip and the neck, respectively, and extend between the first and second side surfaces, respectively. The first and second major surfaces are joined to the first and second side surfaces at rounded edges, respectively.

In one aspect of the disclosure, an outer portion of the first major surface, which is at least partially disposed between the tip and the outer end of the slot, is flat and in a first plane. An inner portion of the first major surface located toward the neck either is curved or is flat and in a first other plane that is not parallel to the first plane.

In another aspect of the disclosure, a method of forming an electrically conductive contact having a longitudinal axis is described. In accordance with the method, a length of metal wire is cut from a source of the metal wire. The length of metal wire is configured to form a fastening section connected by a neck to a pin section. The configuring of the length of metal wire includes shaping the length of wire to comprise a first intermediate section, which is barrel-shaped. The first intermediate section is then shaped to form a second intermediate section having first and second side surfaces and first and second major surfaces. The first major surface has an outer portion that is flat and in a first plane and an inner portion that is either curved or is flat and in a first other plane that is not parallel to the first plane. A slot is punched into the second intermediate section so as to extend through the first and second major surfaces. A portion of the length of metal wire connected to an outer end of the fastening section is removed, thereby providing the fastening section with a solid tip. The first and second major surfaces extend between the tip and the neck, respectively. The outer portion of the first major surface is at least partially disposed between the tip and the outer end of the slot, and the inner portion of the first major surface is located toward the neck.

BRIEF DESCRIPTION OF THE DRAWINGS

The features, aspects, and advantages of the present invention will become better understood with regard to the following description, appended claims, and accompanying drawings where:

DETAILED DESCRIPTION OF ILLUSTRATIVE EMBODIMENTS

Figure 1:
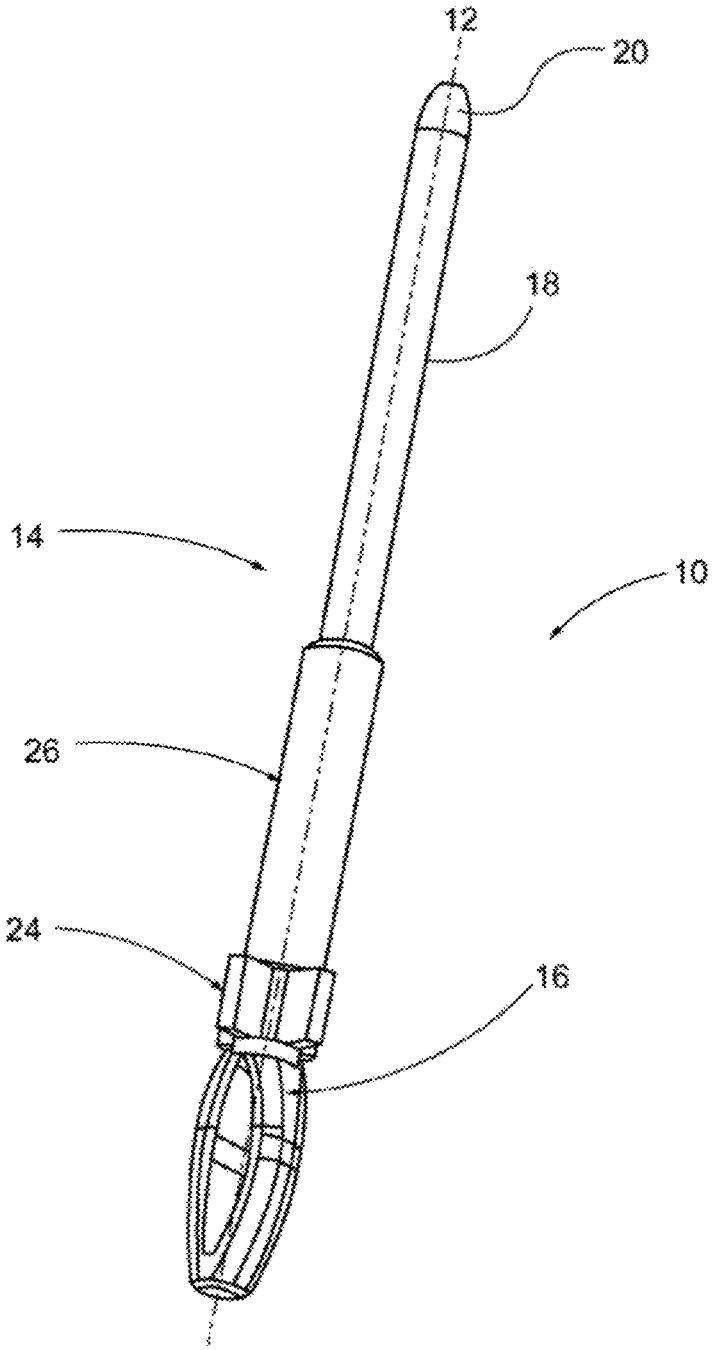
FIG. 1 shows a perspective view of a contact pin of the disclosure.

It should be noted that in the detailed descriptions that follow, identical components have the same reference numerals, regardless of whether they are shown in different embodiments of the present disclosure. It should also be noted that for purposes of clarity and conciseness, the drawings may not necessarily be to scale and certain features of the disclosure may be shown in somewhat schematic form.

Referring now to FIG. 1, there is shown a contact pin 10 constructed in accordance with this disclosure. The contact pin 10 is comprised of a conductive metal (such as tin plated copper alloy) and is elongated, having a longitudinal axis 12. The contact pin 10 includes a pin section 14 integrally joined to a fastening section 16. The pin section 14 includes a pin 18 adapted for insertion into a female connector (not shown) so as to make an electrical connection. The pin 18 has a free end 20 that is tapered to facilitate insertion. Depending on the application, the pin section 14 may also have one or more retention structures, such as large stars 24 and smaller elongated stars (not shown) arranged around the circumference of a retention area 26. As shown, the retention area 26 may have a diameter larger than the pin 18. The retention structures may be used to secure the contact pin 10 to a connector housing or other type of component or part. If provided, the large stars 24 may also function as shoulder stops against which a force may be applied to insert the fastenting section 16 into a hole of a PCB, or other substrate. If the contact pin 10 is not provided with the above-described retention structures, the pin section 14 may be provided with a differently configured shoulder stop.

The contact pin 10 may be formed from wire comprised of the conductive metal and having a circular cross-section. In other embodiments, however, contact pins may be formed from lengths of metal wire having a rectangular cross-section, or from flat stock. The size of the wire or flat stock that is used depends on the application of the contact pin 10. However, the structure of the contact pin 10 and its method of manufacture are ideally suited for utilizing small size wire (e.g. a diameter or width of less than 0.018 inches or 0.0457 cm) to produce small contact pins 10. Although the contact pin 10 and its method of manufacture are ideally suited for this application, it should be appreciated that they can be used for other applications using larger size wire or using flat stock to produce different size contact pins 10. For example, wire or flat stock may be used having a diameter or width of 0.018 inches or greater, such as 0.025 inches, or 0.045 inches, or any other dimension suitable for a particular application, such as use in a PCB. A contact pin 10 for a typical PCB application with small holes will have a fastening section 16 with a width (undeformed) in a range of from about 0.016 inches (0.4 mm) to about 0.024 inches (0.6 mm).

Figure 2:
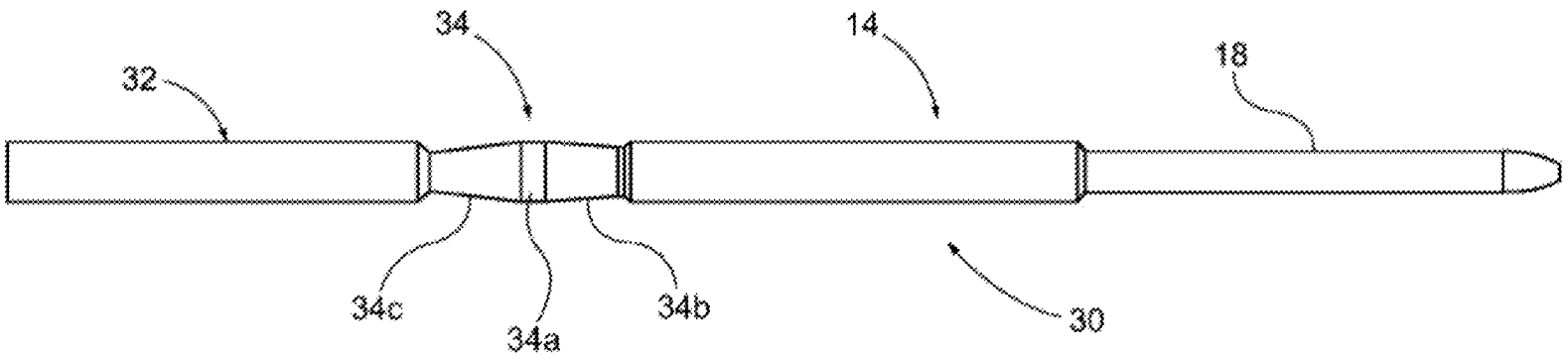
FIG. 2 shows a side view of a length of wire being formed into the contact pin.

The formation of a contact pin 10 begins with a length 30 of wire being cut from a spool or other source of wire. The wire length 30 is then mounted on a bandolier attached at section 32 or another location on length 30, which carries the wire length 30 through various stages of a progressive die to produce a contact pin 10. In a pre-forming stage, a section of the wire length 30 corresponding to the fastening section 16 is pre-formed into an intermediate configuration 34 that will create a desired final configuration when flattened and punched in subsequent stages. FIG. 2 shows the wire length 30 after the pre-forming stage has been performed to produce an intermediate configuration 34. As shown, the intermediate configuration 34 is barrel-shaped, having a cylindrical center section 34*a* disposed between two tapered end sections 34*b*, 34*c*.

After the pre-forming stage, the intermediate configuration 34 is flattened in a pressing stage to produce an elongated, flattened ellipsoid-like shape. In a subsequent punching stage, a slot is formed in the ellipsoid using a punch and die. The resulting configuration is the fastening section 16, which is described below with particular reference to FIGS. 3 and 4.

The fastening section 16 includes a tip 38 and a neck 40. The tip 38 has a substantially circular, planar face 38*a* and is solid, i.e., an axial bore does not extend through the face 38*a*. The face 38*a* is disposed in a plane perpendicular to the longitudinal axis 12. The neck 40 is cylindrical and is joined to the pin section 14, such as at the stars 24. Opposing first and second major surfaces 42, 44 extend in the direction of the longitudinal axis 12 between the neck 40 and the tip 38, respectively. Opposing first and second side surfaces 46, 48 also extend in the direction of the longitudinal axis 12 between the neck 40 and the tip 38, respectively. In addition, the first and second side surfaces 46, 48 extend between the first and second major surfaces 42, 44, respectively, in a direction normal to the longitudinal axis 12. Each of the first and second side surfaces 46, 48 is arcuate in the longitudinal direction, as well as in the normal direction. The first and second side surfaces 46, 48 may be fully arcuate (rounded) in both the longitudinal direction and in the normal direction, or they may have portions that are straight. The first and second major surfaces 42, 44 join the first and second side surfaces 46, 48 at rounded edges, respectively.

The slot formed in the punching stage (designated by the reference numeral 52) extends through openings in the first and second major surfaces 42, 44, respectively, in the normal direction. The slot 52 is elongated and extends most of the distance between the neck 40 and the tip 38. An outer end 52*a* of the slot 52 is disposed proximate to the tip 38, while an inner end 52*b* of the slot 52 is disposed proximate to the neck 40. The slot 52 is defined by an elliptical-like shaped inner wall 53 that extends linearly in the normal direction. In this manner, the openings for the slot 52 in the first and second major surfaces 42, 44 are the same size and are aligned.

The slot 52 creates a pair of beams 56, 58 that are joined at the neck 40 and and the tip 38 and are separated by the slot 52. The beams 56, 58 are resiliently movable toward and away from each other. This resiliency permits the beams 56, 58 to move toward each other when the fastening section 16 is being inserted into a hole of a substrate and then, when they are disposed in the hole, to exert outwardly-directed forces against an interior wall of the hole so as to retain the fastening section 16 in the hole. The round shape of the tip 38, the arcuate contours of the first and second side surfaces 46, 48, and the rounded edges joining the first and second side surfaces 46, 48 to the first and second major surfaces 42, 44 all facilitate the insertion of the fastening section 16 into the hole and help prevent damage to the substrate around the hole.

The contours of the first and second major surfaces 42, 44 also affect the insertion and/or retention of the fastening section 16 in a substrate hole. Each of the first and second major surfaces 42, 44 may be entirely flat and disposed in a plane parallel to the longitudinal axis 12. Alternately, one or both of the first and second major surfaces 42, 44 may not be entirely flat. For example, one or both of the first and second major surfaces 42, 44 may be partially flat and partially tapered, and the tapered portion may be flat or curved. Illustrations of such contouring will be described with reference to FIGS. 3-6.

Figure 3:
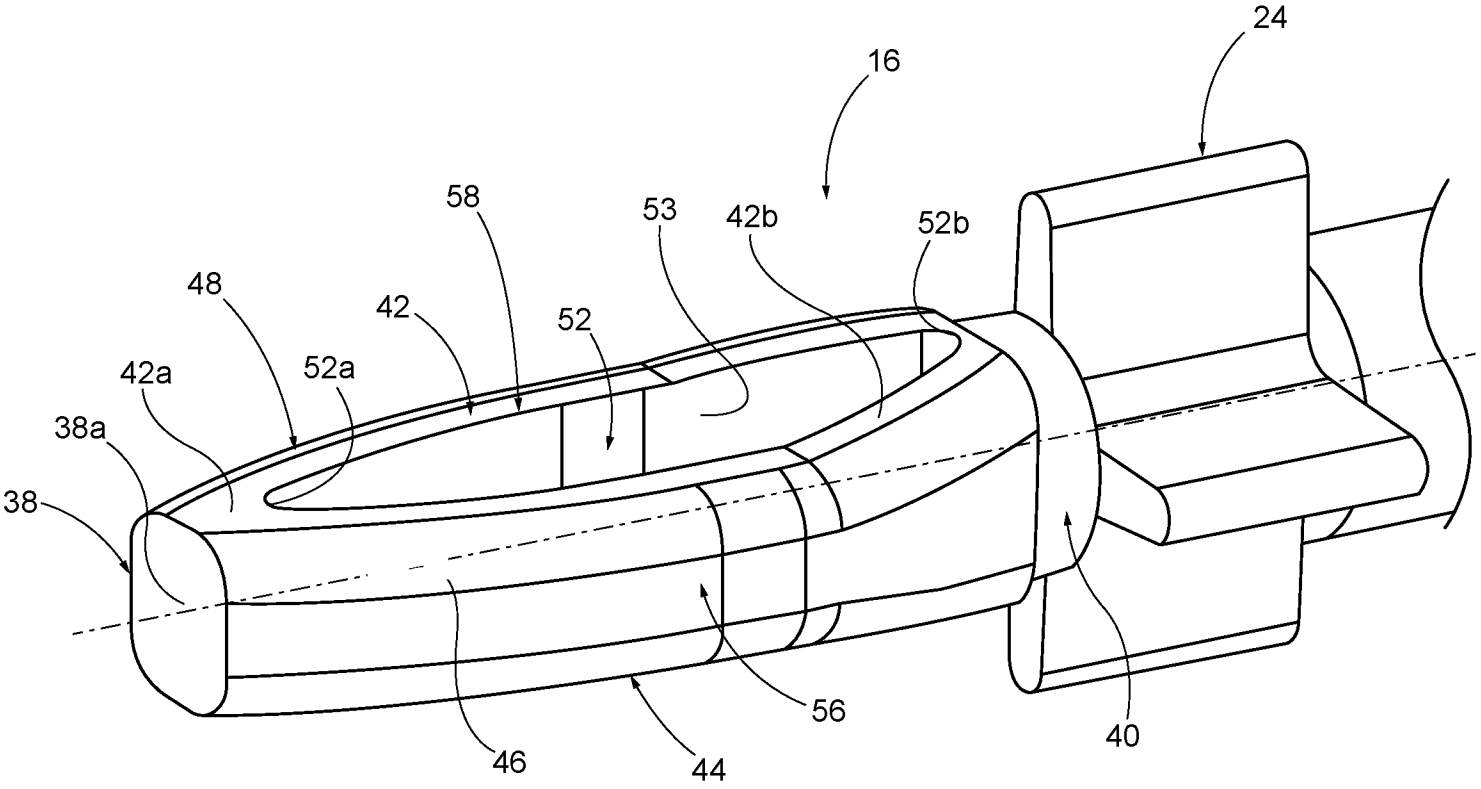
FIG. 3 shows a side perspective view of a fastening section of the contact pin.
Figure 5:
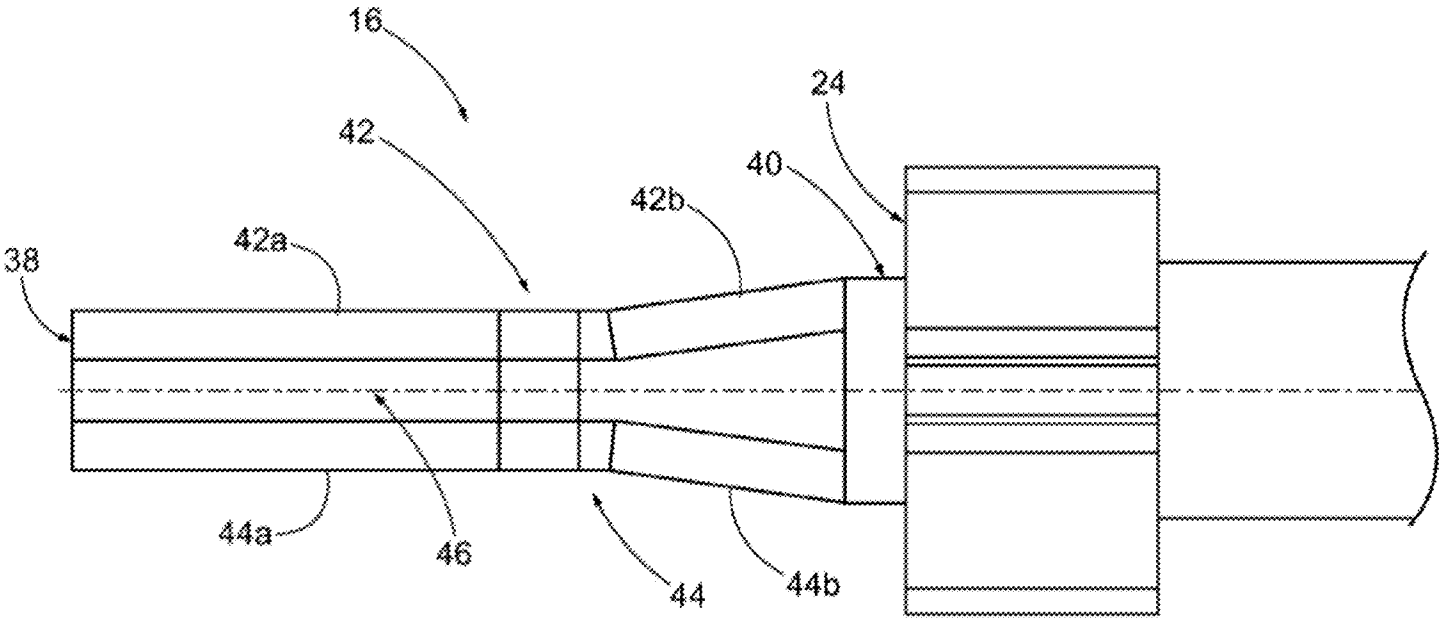
FIG. 5 shows a side view of the fastening section of FIG. 3.

As best illustrated in FIGS. 3 and 5, the first major surface 42 may have two portions: an outer portion 42*a* and an inner portion 42*b*. Similarly, the second major surface 44 may have an outer portion 44*a* and inner portion 44*b*. The outer portions 42*a*, 44*a* extend inwardly from the tip 38 to past the outer end 52*a* of the slot 52 and are flat. The outer portions 42*a*, 44*a* may be disposed in planes parallel to the longitudinal axis 12 (as shown), or one or both may have a straight taper, i.e., disposed in a plane extending at an outward angle from the longitudinal axis 12 (in the direction from the tip 38 to the neck 40). Although the outer portions 42*a*, 44*a* are shown extending beyond the midpoint of the length of the slot 52, it should be appreciated that the outer portions 42*a*, 44*a* may be shorter, stopping short of the midpoint, or may even be longer, extending further toward the neck 40. As shown, the inner portions 42*b*, 44*b* of the first and second major surfaces 42, 44 are also flat. However, one or (as shown) both of the inner portions 42*b*, 44*b* has a straight taper, i.e., is disposed in a plane extending at a slight outward angle from the longitudinal axis 12 (in the direction from the tip 38 to the neck 40). If both the outer portions 42*a*, 44*a* and the inner portions 42*b*, 44*b* are straight tapered, the tapers may be the same or different between the inner and outer portions. For example, the tapers of the outer portion 42*a*, 44*a* may be greater than the tapers of the inner portions 42*b*, 44*b*. In addition, the tapers (if any) of the outer portions 42*a*, 44*a* may be different to each other, and the tapers of the inner portions 42*b*, 44*b* may be different to each other.

Figure 6:
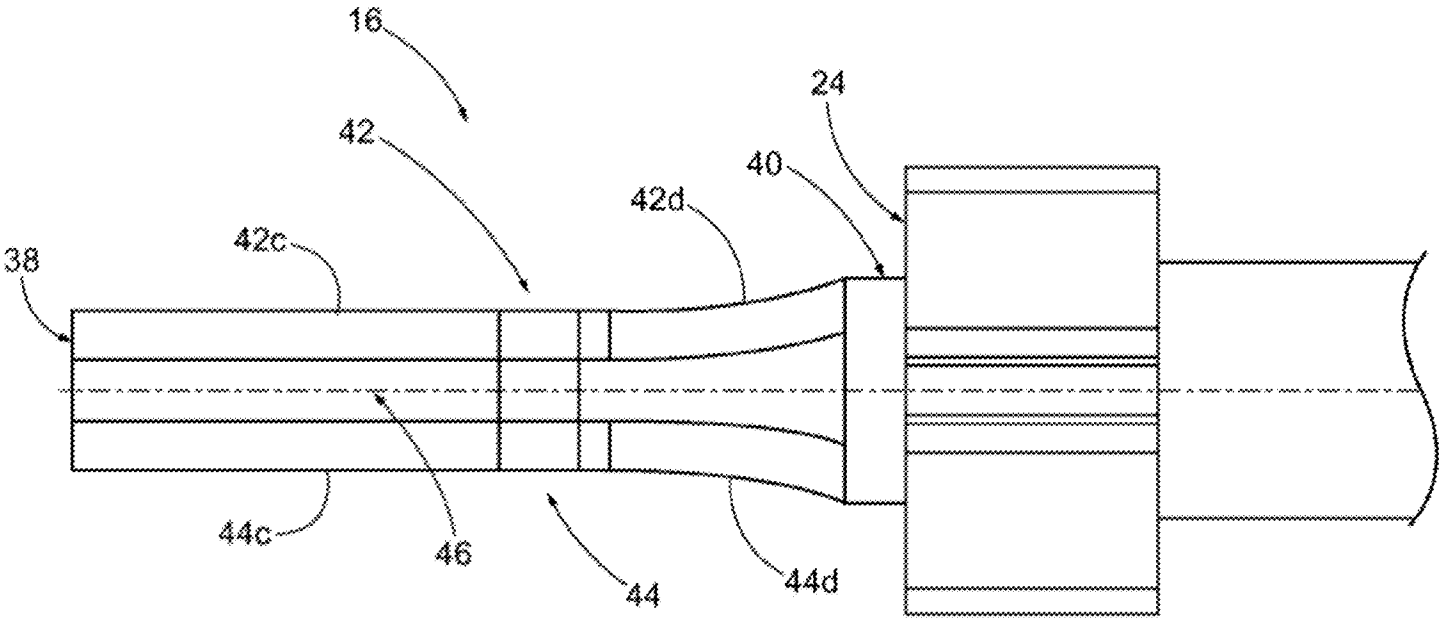
FIG. 6 shows a side view of another embodiment of the fastening section.

Referring now to FIG. 6, there is shown another embodiment of the disclosure, wherein the first major surface 42 has an outer portion 42*c* and an inner portion 42*d*, and the second major surface 44 has an outer portion 44*c* and inner portion 44*d*. Similar to the previously described embodiment, the outer portions 42*c*, 44*c* extend inwardly from the tip 38 to past the outer end 52*a* of the slot 52 and are flat. Again, the outer portions 42*c*, 44*c* may be disposed in planes parallel to the longitudinal axis 12 (as shown), or one or both may have a straight taper, i.e., disposed in a plane extending at an outward angle from the longitudinal axis 12 (in the direction from the tip 38 to the neck 40). The outer portions 42*c*, 44*c* extend beyond the midpoint of the length of the slot 52, but the outer portions 42*c*, 44*c* may be shorter, stopping short of the midpoint, or may even be longer, extending further toward the neck 40. One or (as shown) both of the inner portions 42*d*, 44*d* of the first and second major surfaces 42, 44 are not flat; one or (as shown) both have a curved taper. One or (as shown) both of the inner portions 42*d*, 44*d* gently curve outward from the longitudinal axis 12 (in the direction from the tip 38 to the neck 40). While both inner portions 42*d*, 44*d* are shown having about the same curvature, it should be appreciated that the curvatures may differ between them. It should further be appreciated that one or both of the outer portions 42*c*, 42*d* may also have a curved taper instead of being planar (as shown).

Although not shown, the tip 38 may be beveled. The beveling may be done around the entire periphery of the face 38*a* so that the first and second major surfaces 42, 44 and the first and second side surfaces 46, 48 do not join the face 38*a* as shown in FIG. 3. Instead, beveled surfaces may be disposed therebetween. Alternately, the beveling may be done only between the face 38*a* and the first and second major surfaces 42, 44, or only between the face 38*a* and the first and second side surfaces 46, 48.

The contouring of the first and second major surfaces 42, 44 permits the insertion force characteristics of the fastening section 16 to be tailored for a particular application. In many applications, the substrate containing the hole into which the fastening section 16 is to be inserted can be easily damaged, particularly at the beginning part of the insertion process. In these applications, it is desirable to have a lower initial insertion force, while still having robust retaining forces that secure the fastening section 16 in the hole. This desirable characteristic can be augmented by providing the inner portions of the first and second major surfaces 42, 44, respectively, with the shown and described tapering (straight and/or curved). As the fastening section 16 is inserted further into the hole, the cross-section of the fastening section 16 in the normal direction gradually increases due to the tapers, thereby gradually increasing the required insertion force and increasing the outward forces applied by the inner portions against the interior wall of the hole. These outward forces reach a maximum at the innermost ends of the inner portions, and then function as retaining forces, keeping the fastening section 16 secured in the hole.

The contouring of the first and second major surfaces 42, 44 as well as the shaping of the other features of the fastening section 16 can be facilitated by the shaping of the pre-form in the wire length 30 during the pre-forming stage. For example, the barrel shape of the intermediate configuration 34 helps provide the fastening section 16 with a substantially ellipsoid shape after it has been flattened. The shape of this ellipsoid may be modified by, for example, reducing or eliminating the cylindrical center section 34*a* of the intermediate configuration 34, which would cause the first and second side surfaces 46, 48 to be more arcuate after the intermediate configuration 34 is flattened.

Figure 4:
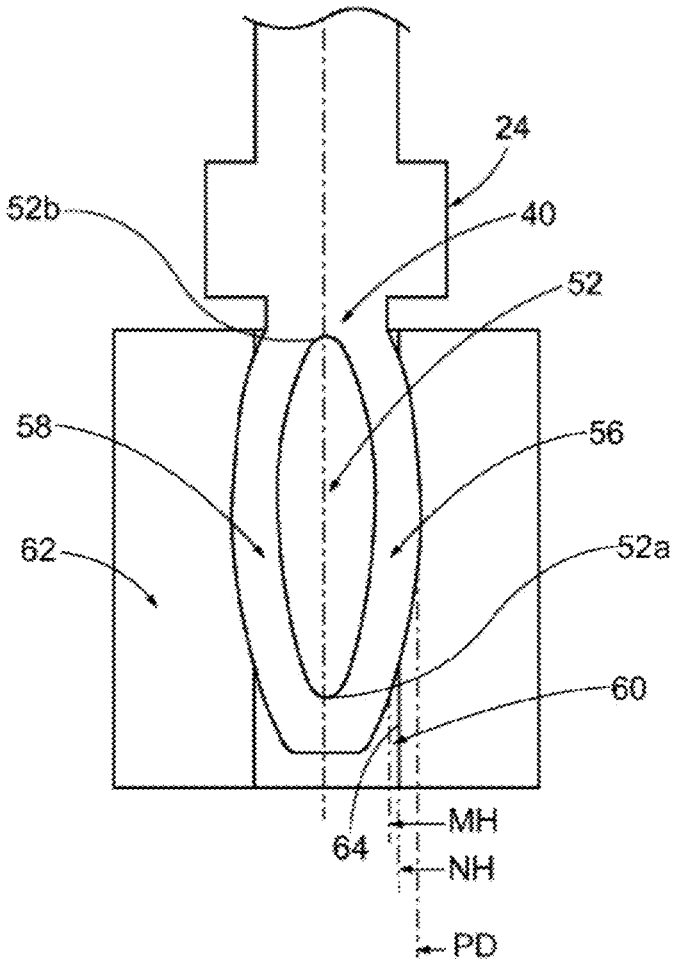
FIG. 4 shows a schematic representation of the fastening section relative to a hole in a substrate into which the fastening section is to be inserted.
Figure 7:
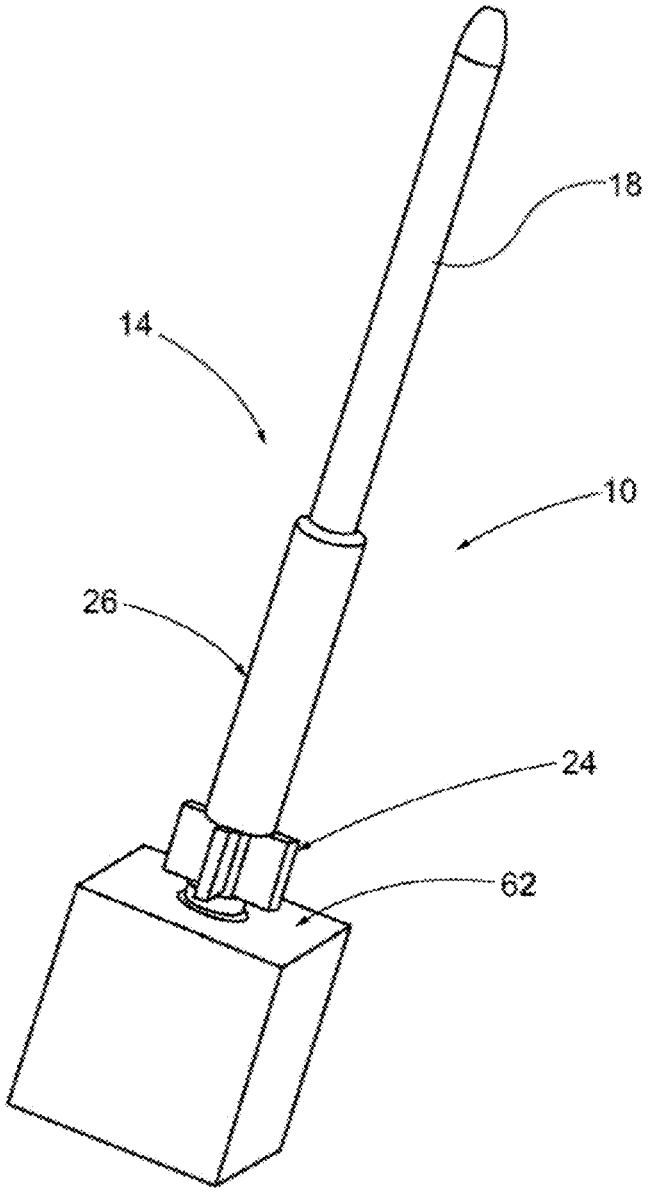
FIG. 7 shows a perspective view of the contact pin mounted to a substrate.

Once the fastening section 16 (as described above) has been formed in the progressive die, the contact pin 10 is typically electroplated and then removed from the wire section 32 that is held by the bandolier. The fastening section 16 of the contact pin is then inserted into a hole of a substrate, such as a metal-plated hole of a PCB. Such insertion may be performed by an automatic insertion machine. Alternately, the pins can be inserted into a connector housing which can be used as a holder to mass insert several pins into a PCB at the same time. FIG. 4 shows a schematic representation of the fastening section 16 relative to such a hole 60 in a substrate 62. The fastening section 16 is not shown compressed, as it would be when inserted into the hole 60, but rather is shown overlaying the hole 60 for illustrative purposes only. When, the fastening section 16 is fully inserted into the hole 60, the beams 56, 58 are compressed toward each other and exert outwardly-directed forces against an interior wall 64 of the hole 60 so as to retain the fastening section 16 in the hole. As shown in FIG. 7, the pin section 14 extends upwardly from a top surface of the substrate 62. No part of the fastening section 16 extends beyond a bottom surface of the substrate 62. This feature is desirable for some applications (such as high speed signal applications), but is often not required.

In FIG. 4, the dimension PD is the lateral width of the fastening section 16 in an undeformed state, (i.e., before it is inserted into the hole 60), the dimension NH is the nominal width of the hole 60, and the dimension MH is the minimum width of the hole 60.

It is to be understood that while the foregoing descriptions are focused on contact pins for use in connecting to electrically conductive holes of PCBs, the described embodiments can be applied generally to any member that is required to be press-fit into an opening. It is to be further understood that the description of the foregoing exemplary embodiment(s) is (are) intended to be only illustrative, rather than exhaustive. Those of ordinary skill will be able to make certain additions, deletions, and/or modifications to the embodiment(s) of the disclosed subject matter without departing from the spirit of the disclosure or its scope.

What is claimed is:

1. An electrically conductive contact for mounting to a substrate having a hole formed therein, the contact having a longitudinal axis and comprising:

an elongated electrically conductive pin section extending along the longitudinal axis; and a fastening section connected to the pin section and having an enlarged through-slot extending therethrough in a direction normal to the longitudinal axis, the through-slot having an inner end disposed proximate the pin section and an outer end disposed distal to the pin section, the fastening section being adapted for press-fitting into the hole of the substrate and comprising:

a solid tip;

a neck connected to the pin section;

first and second side surfaces;

opposing first and second major surfaces through which the enlarged through-slot extends, the first and second major surfaces extending longitudinally between the tip and the neck, respectively, and extending between the first and second side surfaces, respectively, the first and second major surfaces being joined to the first and second side surfaces at rounded edges, respectively;

wherein an outer portion of the first major surface extends inwardly from the tip to a point farther inward than the outer end of the slot and is flat and in a first plane; and wherein an inner portion of the first major surface extends inwardly from a point outward of the inner end of the slot to a point proximate the neck and either is curved or is flat and in a first other plane that is not parallel to the first plane.

2. The contact of claim 1, wherein the inner portion of the first major surface is planar and slopes away from the longitudinal axis as the inner portion of the first major surface extends inwardly toward the neck.

3. The contact of claim 1, wherein the inner portion of the first major surface curves away from the longitudinal axis as the inner portion of the first major surface extends inwardly toward the neck.

4. The contact of claim 1, wherein an outer portion of the second major surface extends inwardly from the tip to a point farther inward than the outer end of the slot and is flat and in a second plane; and wherein an inner portion of the second major surface extends inwardly from a point outward of the inner end of the slot to a point proximate the neck and either is curved or is flat and in a second other plane that is not parallel to the second plane.

5. The contact of claim 4, wherein the inner portion of the second major surface is planar and slopes away from the longitudinal axis as the inner portion of the second major surface extends inwardly toward the neck.

6. The contact of claim 4, wherein the inner portion of the second major surface curves away from the longitudinal axis as the inner portion of the second major surface extends inwardly toward the neck.

7. The contact of claim 4, wherein the first and second planes are parallel to the longitudinal axis.

8. The contact of claim 1, wherein the first and second side surfaces each extend arcuately between the tip and the neck and extend arcuately between the first and second major surfaces.

9. The contact of claim 1, wherein the fastening section further comprises an elliptical inner wall that defines the through-slot, the inner wall extending in the direction normal to the longitudinal axis.

10. The contact of claim 1, wherein the contact is comprised of a copper alloy.

11. The contact of claim 1, wherein the pin section comprises a pin having a circular cross-section.

12. The contact of claim 1, wherein the tip has a face disposed in a plane perpendicular to the longitudinal axis.

13. The contact of claim 1, wherein the through-slot forms a pair of beams that are joined at the neck and the tip and are separated by the through-slot, the beams being resiliently movable toward and away from each other.

14. The contact of claim 13, wherein an outer portion of the second major surface is flat and in a second plane, and wherein an inner portion of the second major surface located toward the neck either is curved or is flat and in a second other plane that is not parallel to the second plane.

15. The contact of claim 14, wherein the outer portion of the second major surface extends inwardly from the tip to a point farther inward than the outer end of the slot, and wherein the first and second planes are parallel to the longitudinal axis.

16. The contact of claim 15, wherein each of the inner portions of the first and second major surfaces is planar and slopes away from the longitudinal axis as the inner portion extends inwardly toward the neck.

17. The contact of claim 15, wherein each of the inner portions of the first and second major surfaces curves away from the longitudinal axis as the inner portion extends inwardly toward the neck.

* * * * *